US011980243B2

(12) United States Patent
Hackathorn

(10) Patent No.: US 11,980,243 B2
(45) Date of Patent: May 14, 2024

(54) MICROCHIP SECURITY PROTECTION GLOVE DEVICE

(71) Applicant: Brad Hackathorn, Louisville, OH (US)

(72) Inventor: Brad Hackathorn, Louisville, OH (US)

( * ) Notice: Subject to any disclaimer, the term of this patent is extended or adjusted under 35 U.S.C. 154(b) by 66 days.

(21) Appl. No.: 17/860,483

(22) Filed: Jul. 8, 2022

(65) Prior Publication Data

US 2024/0008573 A1 Jan. 11, 2024

(51) Int. Cl.
*A41D 31/26* (2019.01)
*A41D 19/015* (2006.01)

(52) U.S. Cl.
CPC ..... *A41D 31/26* (2019.02); *A41D 19/015* (2013.01)

(58) Field of Classification Search
CPC ..... A41D 31/26; A41D 19/015
USPC ..... 2/159
See application file for complete search history.

(56) References Cited

U.S. PATENT DOCUMENTS 1,154,122 A * 9/1915 Kovesy ..... A41D 19/002 2/160
4,438,532 A * 3/1984 Campanella ..... A41D 19/01588 2/161.1
6,453,474 B2 * 9/2002 Kleinert ..... A63B 71/146 2/161.1
6,986,779 B2 * 1/2006 Begley ..... A61H 39/04 602/53
7,188,373 B2 * 3/2007 Jaunault ..... A41D 19/01511 2/161.6
7,210,172 B2 * 5/2007 Adams, Jr. ..... A63B 21/4025 2/21
7,487,553 B2 * 2/2009 Price ..... A41D 19/01547 2/161.1
8,482,412 B2 7/2013 Majoros
9,055,798 B2 6/2015 SciclunA
9,538,797 B2 * 1/2017 Jones ..... A41D 19/0013
10,117,473 B2 * 11/2018 Sullivan ..... A41D 19/0017
10,178,815 B1 * 1/2019 Vieyra ..... A45C 5/02
10,285,462 B2 * 5/2019 Charles ..... A63B 71/141
10,709,044 B1 * 7/2020 Judy ..... H05K 9/0009
2005/0114982 A1 * 6/2005 Gremmert ..... A41D 19/01517 2/159
2006/0254815 A1 * 11/2006 Humphrey ..... H05K 9/00 174/378

(Continued)

FOREIGN PATENT DOCUMENTS

WO WO2015003139 1/2015

*Primary Examiner* — Khaled Annis
*Assistant Examiner* — Dakota Marin

(57) ABSTRACT

A microchip security protection glove device for protecting personal microchips implanted in the hand of the user includes a glove worn on a hand of the user. The glove is a radio frequency identification blocking material being configured for protecting a personal information stored within a personal microchip implanted within the hand of the user. The glove further includes a plurality of finger sleeves, a thumb sleeve, a back sleeve, a palm sleeve, and a wrist sleeve. The wrist sleeve has an opening where a band is positioned on. The band compresses the opening against an arm of the user when the glove is positioned on the hand of the user. An access of the glove provides passage through the glove to the personal microchip implanted within the hand of the user. The access has a flap being positioning from a closed position to an open position.

12 Claims, 2 Drawing Sheets

(56) References Cited

U.S. PATENT DOCUMENTS

| | | | | |
|---|---|---|---|---|
| 2013/0276206 | A1* | 10/2013 | DuChene | A41D 19/0048 2/161.4 |
| 2015/0027831 | A1 | 1/2015 | Case | |
| 2015/0082512 | A1* | 3/2015 | McGraw | A41D 19/0037 2/159 |
| 2015/0189933 | A1* | 7/2015 | Einesson | A41D 19/01511 2/16 |
| 2019/0087705 | A1 | 3/2019 | Bourque | |
| 2020/0334510 | A1 | 10/2020 | Hu | |

* cited by examiner

MICROCHIP SECURITY PROTECTION GLOVE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to radio frequency identification protection device and more particularly pertains to a new radio frequency identification protection device for protecting personal microchips implanted in the hand of the user.

(2) Description of Related Art Including Information Disclosed Under 37 CFR 1.97 and 1.98

The prior art relates to radio frequency identification protection devices. The prior art includes a variety of radio frequency identification protection devices configured to obstruct the gathering of information by radio frequency. Known prior art lacks a radio frequency identification protection device being a glove configured to protect a personal microchip implanted within the hand of the user.

BRIEF SUMMARY OF THE INVENTION

An embodiment of the disclosure meets the needs presented above by generally comprising a glove configured to be worn on a hand of the user. The glove is a radio frequency identification blocking material. The radio frequency identification blocking material is configured for protecting a personal information stored within a personal microchip implanted within the hand of the user. The glove further comprises a plurality of finger sleeves being configured for enwrapping a respective one of a plurality of fingers of the hand of the user. A thumb sleeve is configured for enwrapping a thumb of the hand of the user. A back sleeve is configured for covering a back of the hand of the user. A palm sleeve is configured for covering a palm of the hand of the user. A wrist sleeve is configured for covering the wrist of the user. The wrist sleeve has an opening defining a space for the hand of the user to be inserted into the glove. A band is positioned on the opening of the glove. The band is configured for compressing the opening against an arm of the user when the glove is positioned on the hand of the user. An access of the glove is configured for providing passage through the glove to the personal microchip implanted within the hand of the user. The access has a flap being configured for positioning from a closed position to an open position.

Furthermore, a method for protecting personal information using a security glove includes the step of inserting the hand of the user within an opening of a glove. The plurality of fingers of the hand of the user nests within a respective one of a plurality of finger sleeves of the glove. The user positions a back sleeve of the glove on the back of the hand of the user and a palm sleeve of the glove on the palm of the hand of the user. A band of the opening compresses around the arm of the user. Subsequently, the user positions a flap of the access in a closed position thus covering a personal microchip implanted within the hand of the user wherein protecting the personal information stored within the personal microchip. Alternately, the user positions the flap of the access in an open position thus exposing the personal microchip implanted within the hand of the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figures 1, 2:
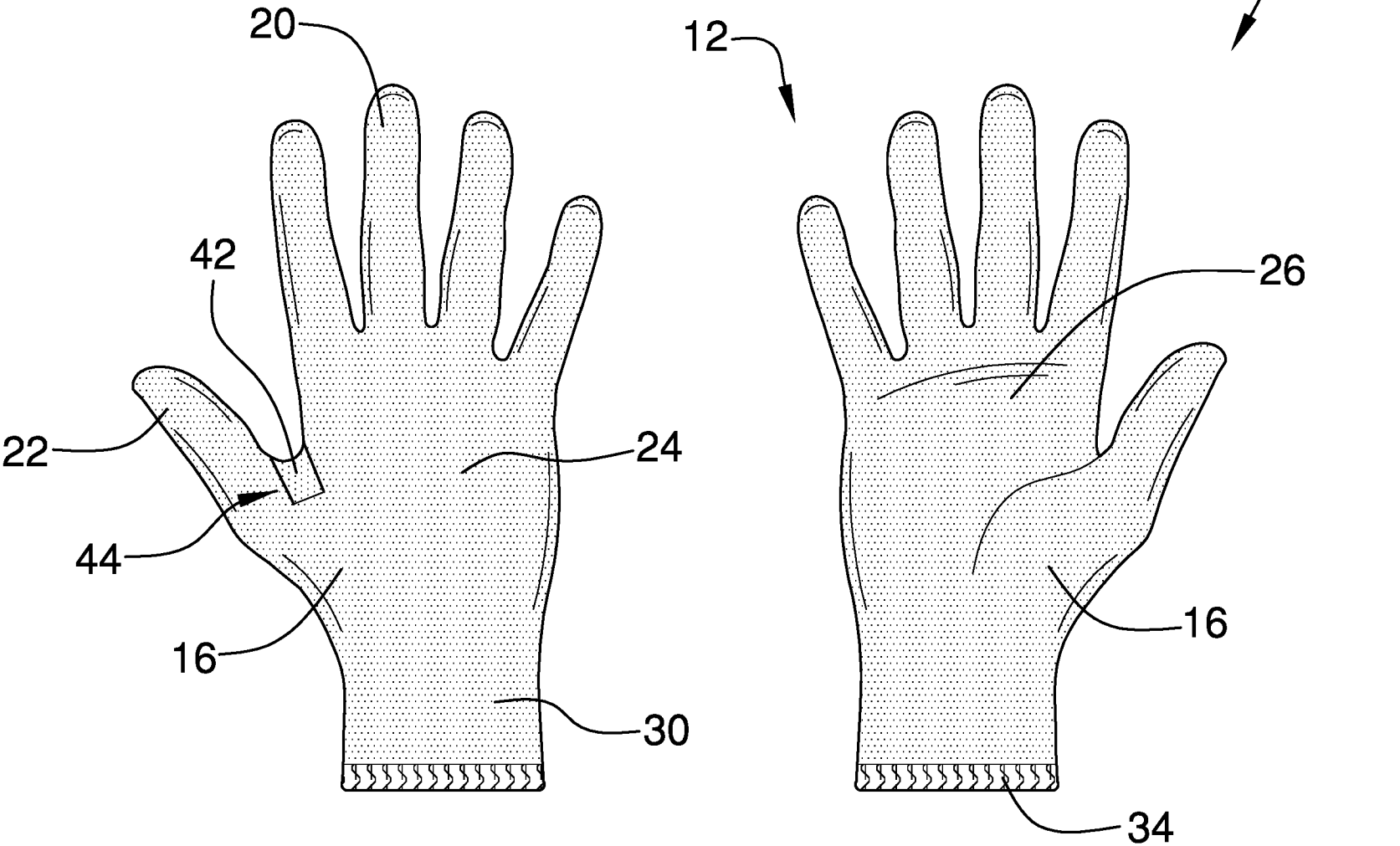
FIG. 1 is a front view of a microchip security protection glove device according to an embodiment of the disclosure.
FIG. 2 is a rear view of an embodiment of the disclosure.
Figure 3:
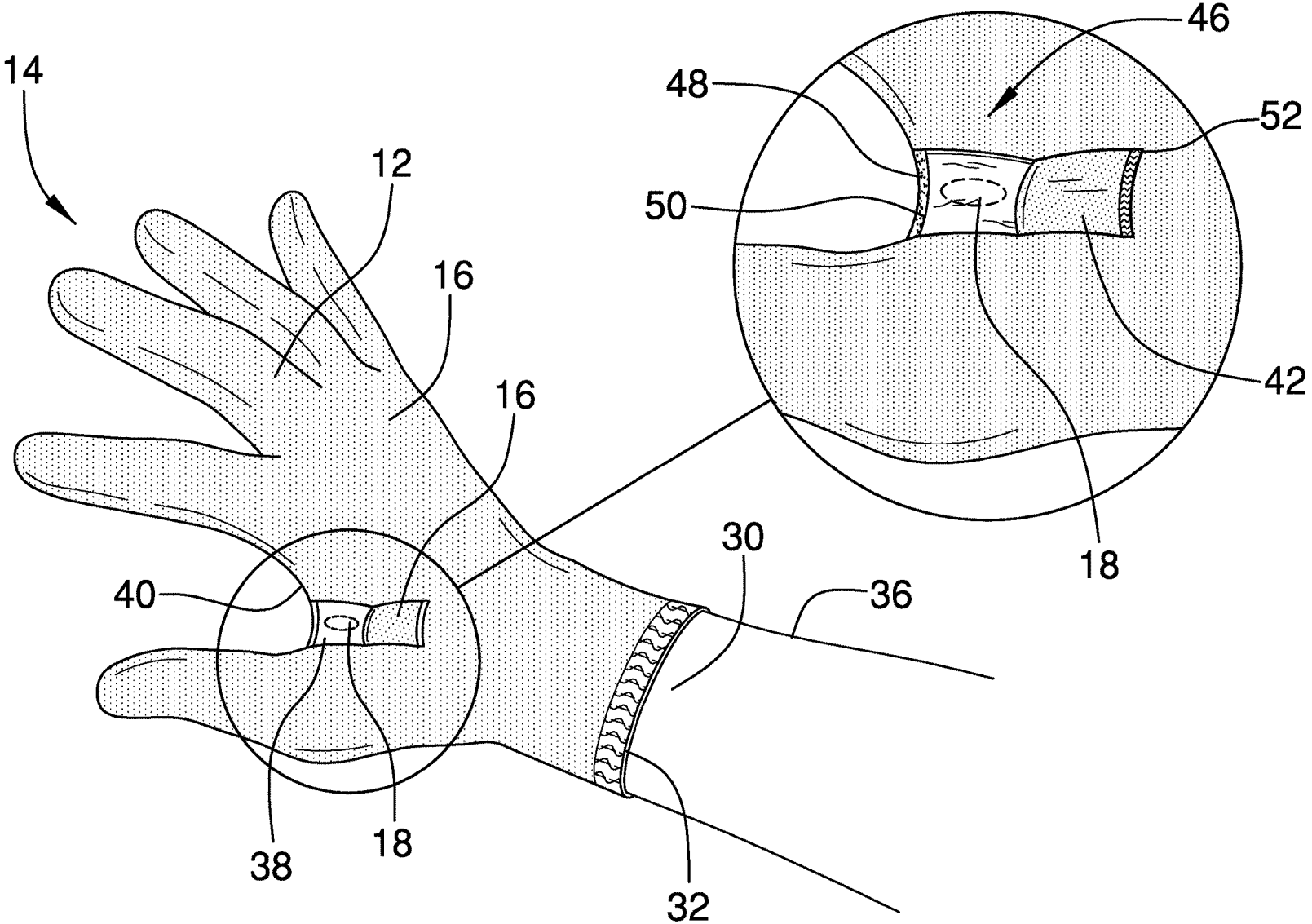
FIG. 3 is a front isometric view of an embodiment of the disclosure.

With reference now to the drawings, and in particular to FIGS. 1 through 3 thereof, a new radio frequency identification protection device embodying the principles and concepts of an embodiment of the disclosure and generally designated by the reference numeral 10 will be described.

As best illustrated in FIGS. 1 through 3, the microchip security protection glove device 10 generally comprises a glove 12 configured to be worn on a hand 14 of the user. In addition, the glove 12 is configured for fitting a range of sizes of hands. The glove 12 is a radio frequency identification blocking material 16 being configured for protecting a personal information stored within a personal microchip 18 implanted within the hand 14 of the user. The glove 12 further comprises a plurality of finger sleeves 20. The plurality of finger sleeves 20 is configured for enwrapping a respective one of a plurality of fingers of the hand 14 of the user. Each of the finger sleeves 20 is the radio frequency identification blocking material 16.

Furthermore, the glove 12 includes a thumb sleeve 22. The thumb sleeve 22 is configured for enwrapping the thumb of the hand 14 of the user. The thumb sleeve 22 is the radio frequency identification blocking material 16. A back sleeve 24 is configured for covering a back of the hand 14 of the user. The back sleeve 24 is coupled to the plurality of finger sleeves 20 and the thumb sleeve 22. The back sleeve 24 is the radio frequency identification blocking material 16. A palm sleeve 26 is configured for covering a palm of the hand 14 of the user. The palm sleeve 26 is the radio frequency identification blocking material 16. The palm sleeve 26 is coupled to the plurality of finger sleeves 20 and to the back sleeve 24 wherein the palm sleeve 26 and the back sleeve 24 are positioned facing each other.

A wrist sleeve 28 is configured for covering a wrist 30 of the user. The wrist sleeve 28 is the radio frequency identification blocking material 16. The wrist sleeve 28 is coupled to the back sleeve 24 and the palm sleeve 26. The wrist sleeve 28 has an opening 32 defining a space for the hand 14 of the user to be inserted into the glove 12. A band 34 is positioned on the opening 32 of the glove 12. The band 34 is an elastic material being configured for being supple and stretchable. The band 34 is configured for compressing the opening 32 against an arm 36 of the user when the glove 12 is positioned on the hand 14 of the user. The band 34 helps retain the glove 12 in place upon the hand 14 of the user.

An access 38 of the glove 12 is an aperture being configured for providing passage through the glove 12 to the personal microchip 18 implanted within the hand 14 of the user. The access 38 is positioned on a junction between the palm sleeve 26 and the back sleeve 24. Additionally, the access 38 is positioned in a center 40 from the plurality of finger sleeves 20 to the thumb sleeve 22. The access 38 has a flap 42 being the radio frequency identification blocking material 16. The flap 42 is separate from the opening 32 of the glove 12, and configured to be positioned adjacent a purlicue of the hand of the wearer. The flap 42 is configured for positioning from a closed position 44 to an open position 46. The closed position 44 is configured for covering the personal microchip 18 of the hand 14 of the user. Alternately, the open position 46 is configured for exposing the personal microchip 18 of the hand 14 of the user. The access 38 has a strip 48 being a loop material 50, and the flap 42 has a hook material 52. The hook material 52 of the flap 42 is complementary to the loop material 50 of the strip 48 of the access 38. The flap 42 is configured for engaging by hook and loop fastening to the strip 48 of the access 38.

In use, the hand 14 of the user inserts within the opening 32 of a glove 12. The plurality of fingers of the hand 14 of the user nests within a respective one of the plurality of finger sleeves 20 of the glove 12. The user positions the back sleeve 24 of the glove 12 on the back of the hand 14 of the user and the palm sleeve 26 of the glove 12 on the palm of the hand 14 of the user. The band 34 of the opening 32 compresses around the arm 36 of the user. Subsequently, the user positions the flap 42 of the access 38 in the closed position 44 thus covering the personal microchip 18 implanted within the hand 14 of the user and protecting the personal information stored within the personal microchip 18. Alternately, the user positions the flap 42 of the access 38 in an open position 46 thus exposing the personal microchip 18 implanted within the hand 14 of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A security protection glove device configured for preventing information being stolen from a personal microchip implanted within the hand of the user, the security protection glove device comprising:

a glove configured to be worn on a hand of the user, the glove being a radio frequency identification blocking material, the radio frequency identification blocking material being configured for protecting a personal information stored within a personal microchip implanted within the hand of the user, the glove further comprising:

a plurality of finger sleeves being configured for enwrapping a respective one of a plurality of fingers of the hand of the user;

a thumb sleeve being configured for enwrapping a thumb of the hand of the user;

a back sleeve being configured for covering a back of the hand of the user;

a palm sleeve being configured for covering a palm of the hand of the user; and a wrist sleeve being configured for covering a wrist of the user, the wrist sleeve having an opening, the opening defining a space for the hand of the user to be inserted into the glove;

an access of the glove includes an aperture being configured for providing passage through the glove to the hand of the user where the personal microchip implanted within the hand of the user, the access having a flap, the flap being the radio frequency identification blocking material, the flap being configured for positioning over the aperture from a closed position to an open position, the closed position being configured for covering the hand of the user where the personal microchip is implanted within the hand of the user, the open position being configured for exposing the hand of the user where the personal microchip is implanted within the hand of the user; and a band being positioned on the opening of the glove, the band being configured for compressing the opening against an arm of the user when the glove being positioned on the hand of the user; and wherein the flap is separate from the opening of the glove, and configured to be positioned adjacent a purlicue of the hand of the wearer.

2. The security protection glove device of claim 1, further comprising the glove being configured for fitting a range of sizes of the hand.

3. The security protection glove device of claim 1, further comprising each of the finger sleeves being the radio frequency identification blocking material.

4. The security protection glove device of claim 3, further comprising the thumb sleeve being the radio frequency identification blocking material.

5. The security protection glove device of claim 4, further comprising the back sleeve being coupled to the plurality of finger sleeves and the thumb sleeve, the back sleeve being the radio frequency identification blocking material.

6. The security protection glove device of claim 5, further comprising the palm sleeve being the radio frequency identification blocking material, the palm sleeve being coupled to the back sleeve, the palm sleeve and the back sleeve being positioned facing each other.

7. The security protection glove device of claim 6, further comprising the wrist sleeve being the radio frequency identification blocking material, the wrist sleeve being coupled to the back sleeve and the palm sleeve.

8. The security protection glove device of claim 7, further comprising the band being an elastic material, the elastic material being configured for being supple and stretchable.

9. The security protection glove device of claim 8, further comprising the access being positioned on a junction between the palm sleeve and the back sleeve, the access being positioned in a center from the plurality of finger sleeves to the thumb sleeve.

10. The security protection glove device of claim 1, further comprising the access having a strip, the strip being a loop material, the flap having a hook material, the hook material of the flap being complementary to the loop material of the strip of the access, the flap being configured for engaging by hook and loop fastening to the strip of the access.

11. A security protection glove device configured for preventing information being stolen from a personal microchip implanted within the hand of the user, the security protection glove device comprising:

a glove configured to be worn on a hand of the user, the glove being configured for fitting a range of sizes of the hand, the glove being a radio frequency identification blocking material, the radio frequency identification blocking material being configured for protecting a personal information stored within a personal microchip implanted within the hand of the user, the glove further comprising:

a plurality of finger sleeves being configured for enwrapping a respective one of a plurality of fingers of the hand of the user, each of the finger sleeves being the radio frequency identification blocking material;

a thumb sleeve being configured for enwrapping a thumb of the hand of the user, the thumb sleeve being the radio frequency identification blocking material;

a back sleeve being configured for covering a back of the hand of the user, the back sleeve being coupled to the plurality of finger sleeves and the thumb sleeve, the back sleeve being the radio frequency identification blocking material;

a palm sleeve being configured for covering a palm of the hand of the user, the palm sleeve being the radio frequency identification blocking material, the palm sleeve being coupled to the back sleeve, the palm sleeve and the back sleeve being positioned facing each other; and a wrist sleeve being configured for covering a wrist of the user, the wrist sleeve being the radio frequency identification blocking material, the wrist sleeve being coupled to the back sleeve and the palm sleeve, the wrist sleeve having an opening, the opening defining a space for the hand of the user to be inserted into the glove;

a band being positioned on the opening of the glove, the band being an elastic material, the elastic material being configured for being supple and stretchable, the band being configured for compressing the opening against an arm of the user when the glove being positioned on the hand of the user, and an access of the glove includes an aperture being configured for providing passage through the glove to the hand of the user where the personal microchip is implanted within the hand of the user, the access being positioned on a junction between the palm sleeve and the back sleeve, the access being positioned in a center from the plurality of finger sleeves to the thumb sleeve, the access having a flap, the flap being the radio frequency identification blocking material, the flap being configured for positioning over the aperture from a closed position to an open position, the closed position being configured for covering the hand of the user where the personal microchip is implanted within the hand of the user, the open position being configured for exposing the hand of the user where the personal microchip is implanted within the hand of the user, the access having a strip, the strip being a loop material, the flap having a hook material, the hook material of the flap being complementary to the loop material of the strip of the access, the flap being configured for engaging by hook and loop fastening to the strip of the access; and wherein the flap is separate from the opening of the glove, and configured to be positioned adjacent a purlicue of the hand of the wearer.

12. A method for protecting personal information using a security glove, the method including the step of:

inserting the hand of the user within an opening of a glove, nesting the plurality of fingers of the hand of the user within a respective one of a plurality of finger sleeves of the glove, positioning a back sleeve of the glove on the back of the hand of the user, positioning a palm sleeve of the glove on the palm of the hand of the user, a band of the opening compressing around the arm of the user;

positioning a flap of an access in a closed position, the flan being the radio frequency identification blocking material being configured for protecting a personal information stored within a personal microchip implanted within the hand of the user, the access including an aperture being configured for providing passage through the glove to the hand of the user where the personal microchip is implanted within the hand of the user, the flap being configured for positioning over the aperture in the closed position wherein the flap covers the hand of the user where the personal microchip is implanted within the hand of the user thereby-protecting the personal information stored within the personal microchip; and positioning the flap of the access in an open position, the access exposing the hand of the user where the personal microchip is implanted within the hand of the user when the flap is in the open position, and wherein the flap is separate from the opening of the glove, and configured to be positioned adjacent a purlicue of the hand of the wearer.

* * * * *